US006767114B2

(12) United States Patent
Young

(10) Patent No.: US 6,767,114 B2
(45) Date of Patent: Jul. 27, 2004

(54) COMBINATION DIFFUSION/REFLECTION SHIELD FOR OUTDOOR LIGHTING FIXTURES

(76) Inventor: Kathleen F. Young, 18 Dakota Trail, Branchburg, NJ (US) 08876

( * ) Notice: Subject to any disclaimer, the term of this patent is extended or adjusted under 35 U.S.C. 154(b) by 0 days.

(21) Appl. No.: 10/172,822

(22) Filed: Jun. 17, 2002

(65) Prior Publication Data

US 2003/0002286 A1 Jan. 2, 2003

Related U.S. Application Data

(60) Provisional application No. 60/298,525, filed on Jun. 18, 2001.

(51) Int. Cl.[7] ..... F21V 7/00

(52) U.S. Cl. ..... 362/307; 362/351

(58) Field of Search ..... 362/351, 310, 362/311, 153.1, 356, 431, 267, 277, 278, 283, 355, 305, 307

(56) References Cited

U.S. PATENT DOCUMENTS

| | | | | | |
|---|---|---|---|---|---|
| 2,744,192 | A | * | 5/1956 | Rosenthal | 362/282 |
| 3,593,014 | A | * | 7/1971 | Vesely | 362/291 |
| 3,651,320 | A | * | 3/1972 | Lasker | 362/303 |
| 3,671,735 | A | * | 6/1972 | King | 362/307 |
| 3,743,856 | A | * | 7/1973 | Stephans | 362/317 |
| 3,805,055 | A | * | 4/1974 | Cassey | 362/358 |
| 3,833,804 | A | * | 9/1974 | Vesely | 362/291 |
| 4,156,270 | A | | 5/1979 | Beatty | |
| 4,270,161 | A | | 5/1981 | Perretta | |
| 4,337,506 | A | * | 6/1982 | Terada | 362/142 |
| 4,337,507 | A | | 6/1982 | Lasker | |
| 4,358,816 | A | | 11/1982 | Soileau | |
| 4,651,260 | A | | 3/1987 | Lasker | |
| 4,994,947 | A | | 2/1991 | Fesko | |
| 5,055,987 | A | * | 10/1991 | Ellson et al. | 362/277 |
| 5,483,424 | A | | 1/1996 | Lightbody | |
| 6,132,065 | A | | 10/2000 | Wedell et al. | |
| 6,183,108 | B1 | | 2/2001 | Herold | |
| 6,357,892 | B1 | * | 3/2002 | Beadle | 362/267 |

* cited by examiner

*Primary Examiner*—Alan Cariaso
*Assistant Examiner*—Ali Alavi

(57) ABSTRACT

An improved outdoor lighting shield is provided for more efficiently illuminating large areas, such as roadways and parking lots. The shield is comprised of a standard lighting base and bulb, a translucent diffusing cylinder wrapped around the bulb, a reflective strip mounted around the diffusing cylinder, a highly-reflective truncated cone, and a non-reflective inverted cone mounted on top of the truncated cone. The diffusing cylinder softens light to reduce glare in the areas closest to the streetlight. The reflective strip reflects excess light onto the truncated cone, which casts a powerful ring of undiffused light to areas further from the streetlight. Any light that would normally be thrown into the atmosphere, causing light pollution, is caught by the inverted cone, which casts diffused light directly below the streetlight.

11 Claims, 2 Drawing Sheets

COMBINATION DIFFUSION/REFLECTION SHIELD FOR OUTDOOR LIGHTING FIXTURES

CROSS-REFERENCE TO RELATED APPLICATIONS

This application is entitled to the benefit of Provisional Patent Application Ser. No. 60/298,525, filed Jun. 18, 2001.

BACKGROUND

1. Field of Invention

This invention relates to outdoor lighting fixtures, specifically to lighting fixture shields that are used for covering the light bulb in streetlights.

2. Description of Prior Art

In the design of roadways and parking lots, safety is always a major concern. One factor in the design of a safe road or parking lot is lighting, so that the driver or pedestrian is able to clearly see his surroundings at night. That is why streetlights were placed on roads and in parking lots. Most streetlights, however, use light inefficiently by dispersing light to where it is not needed. Such improper shielding leads to decreased visibility, and the inefficient use of light is a direct cause of light pollution. It is estimated that up to 50% of light pollution is caused by poor roadway lighting, and that inefficient lighting costs approximately $2 billion of energy per year in the United States alone.

One attempt by inventors and lighting companies to solve the problem of inefficient lighting was to use larger quantities of light to illuminate an area. This, however, is actually less efficient because large quantities of light can cause glare.

Several attempts have been made by other inventors and by commercial lighting companies to create luminaires that use light more efficiently by diffusing or reflecting light. Such lighting apparatuses as shown in U.S. Pat. No. 5,483,424 produce diffused light, but these are used mainly on film and television sets. Additionally, the light-reflecting elements are used to reflect light from an external source, such as the sun, and not from the bulb itself. The lighting fixtures described in U.S. Pat. Nos. 4,156,270 and 4,358,816 are used for very specific purposes, such as lighting billboards. These luminaires could not be used to light parking lots or other large areas.

The roadway luminaire described in U.S. Pat. No. 4,651,260 focuses on reflecting light to high angles of emissions, but does nothing to decrease light pollution or soften light to low angles of emissions. U.S. Pat. Nos. 4,270,161 and 4,337,507 provide lighting fixtures that decrease the amount of light thrown up into the atmosphere, but again do not decrease glare at small angles.

Several low level fixtures, such as those described in U.S. Pat. Nos. 3,593,014; 3,805,055, 3,833,804, and 5,055,987, attempt to decrease glare or utilize reflecting and diffusing techniques. However, these assemblies are mounted too low to the ground to illuminate a large area, sue as a roadway or parking lot. These light fixtures are designed to illuminate such small areas as driveways and garden pathways.

In view of the present disadvantages of currently available roadway lighting devices, it is desirable to redesign the luminaire to provide a light dispersion pattern that softens light at low angles, reflects light at high angles, and decreases light pollution. This will make the apparatus more efficient and therefore more cost-effective than the streetlights currently being used on roads and in parking lots.

SUMMARY

In accordance with the present invention a streetlight shield comprises a standard lighting base, a translucent diffusing cylinder, a reflective strip wrapped around the cylinder, a highly-reflective truncated cone, and a minimally-reflective inverted cone.

OBJECTS AND ADVANTAGES

Accordingly, several objects and advantages of this invention are:

(a) to provide a lighting shield which will diffuse light to small linear distances;

(b) to provide a lighting shield which will project light to large linear distances;

(c) to provide a lighting shield which will decrease light pollution over conventional streetlight designs;

(d) to provide a lighting shield which will increase the efficiency of the streetlight over currently-used designs by reducing the amount of light needed to illuminate an area, thereby decreasing energy costs;

(e) to provide a lighting shield that, when compared to currently-used streetlight designs, will improve visibility in outdoor areas lit with streetlights—in other words, to provide a safer environment for drivers and pedestrians.

Further objects and advantages of this invention will become apparent from a consideration of the drawings and ensuing description.

DRAWING FIGURES

Figure 1:
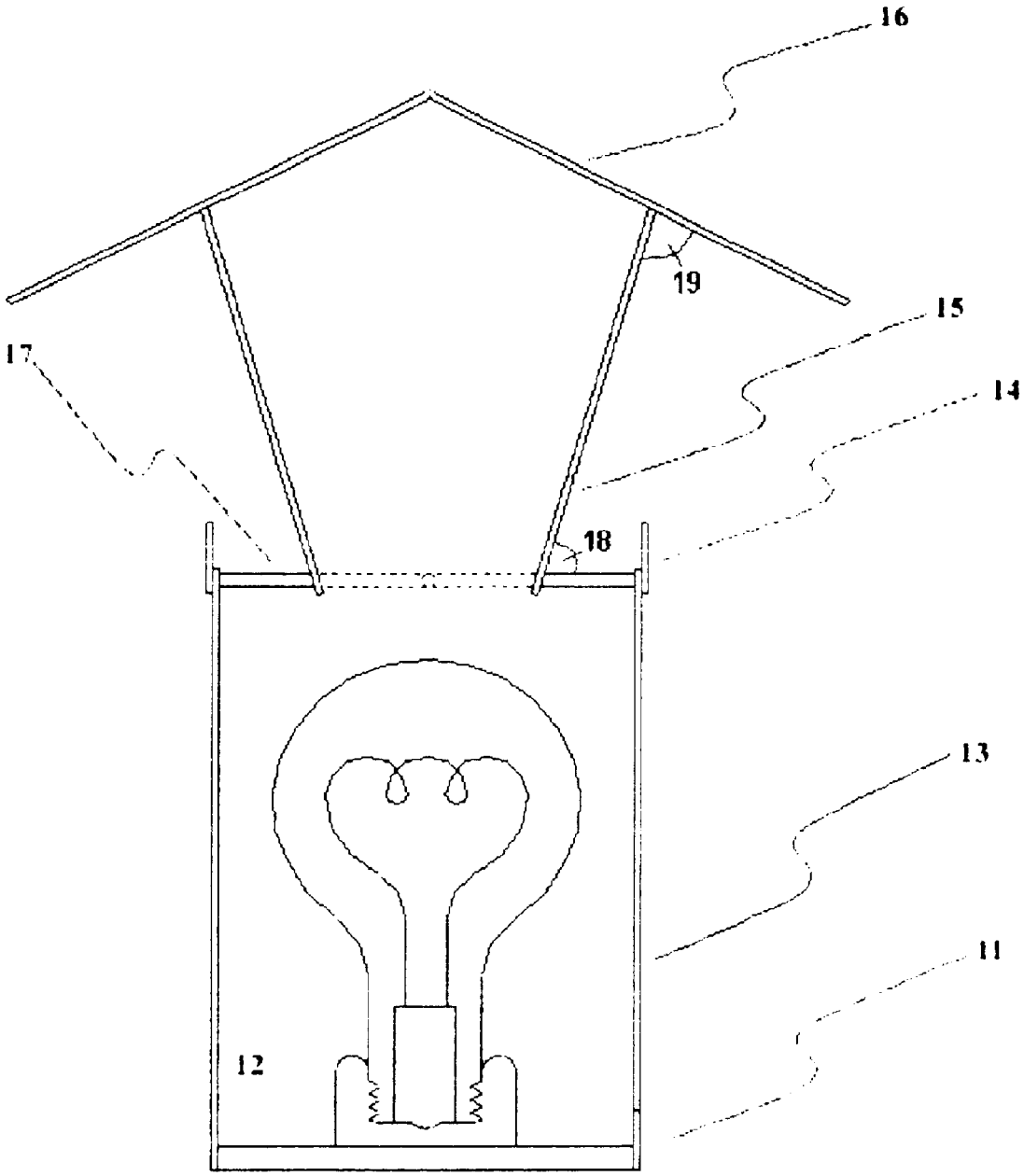
FIG. 1 shows the components of the lighting shield.

| REFERENCE NUMERALS IN DRAWINGS |
|---|
| 11 standard lighting base |
| 12 bulb |
| 13 translucent diffusing cylinder |
| 14 reflective strip |
| 15 truncated cone |
| 16 inverted cone |
| 17 support structure |
| 18 angle between truncated cone and horizontal |
| 19 angle between truncated cone and inverted cone |

DESCRIPTION—FIG. 1—PREFERRED EMBODIMENT

FIG. 1 is a cross-section view of a streetlight shield design for outdoor lighting fixtures. The design consists of a standard lighting base 11, upon which is mounted a bulb 12. A translucent diffusing cylinder 13 is wrapped around base 11, surrounding bulb 12. Cylinder 13 may be screwed, glued, or thermally bonded to base 11. A reflective strip 14 wrapped around cylinder 13 reflects light onto a highly reflective truncated cone 15, which reflects an undiffused ring of light over long distances. Truncated cone 15 is secured to cylinder 13 with support structure 17. Support structure 17 consists of crossbars screwed, glued, or otherwise mounted onto truncated cone 15 and cylinder 13. An inverted cone 16 with a minimally reflective inner surface controls the reflected light pattern and casts a softened ring of light directly below the shield.

Alternative Embodiments

Many variations on the above embodiment are possible. For example, there are various possibilities with regard to the angle between the truncated cone and the horizontal, and the angle between the truncated cone and the inverted cone. The truncated cone, inverted cone, or the diffusing cylinder could be altered in dimension to affect the amount of light diffused and reflected. Simple changes in the height of a component of the lighting shield would create a completely different light dispersion pattern. Additionally, different materials may be used to construct the diffusing cylinder, truncated cone, reflective strip, or inverted cone. By altering the reflective or diffusive properties of one or more of the components, the light dispersion pattern may be altered. Thus, it is possible to customize the lighting shield to the environment in which it is to be used.

Advantages

From the description above, a number of advantages of the combination diffusion/reflection shield become evident:

(a) The presence of a translucent diffusing cylinder causes the light illuminating those areas in close proximity to the streetlight to be diffused, or softened.

(b) The presence of a reflective strip and a reflective truncated cone causes light to be projected to areas farther away from the streetlight.

(c) The presence of a non-reflective inverted cone causes light that would otherwise be reflected into the atmosphere to be blocked and redirected, thereby decreasing light pollution.

(d) A more efficient use of the light available, as compared with conventional streetlight designs, makes it possible to use less light to illuminate an area, thus decreasing costs.

(e) Improving visibility in streetlight-lit areas over conventional streetlight designs provides a safer environment for drivers and pedestrians.

Figure 2:
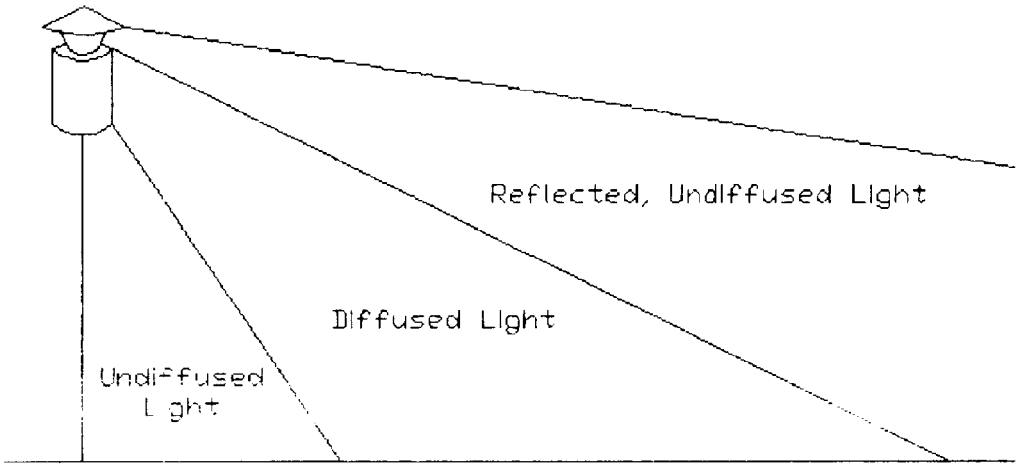
FIG. 2 shows an approximate light dispersion pattern when the lighting shield is used with a standard streetlight.

Operation—FIGS. 1, 2

The design incorporates a combination of reflecting and diffusing components to project a powerful ring of reflected light over long distances while casting a softened, diffused light over short distances. The design presented greatly improves visibility in outdoor areas lit with streetlights, as compared with conventional streetlight designs. It also decreases light pollution and decreases the amount of energy required to efficiently light an outdoor area as compared to conventional designs.

The diffusing cylinder 13 diffuses light that illuminates the areas closest to the streetlight. Reflective strip 14 aids in reflecting light onto truncated cone 15 and prevents stray light from entering the atmosphere. Truncated cone 15 reflects undiffused light to longer distances, enabling better visibility at larger distances away from the streetlight as compared to current streetlight designs. Inverted cone 16 prevents reflected light from entering the atmosphere and indirectly illuminates the area below the lighting fixture.

An approximate lighting dispersion pattern is shown in FIG. 2. As illustrated, the shield reflects light to those areas farther away from the streetlight and casts a ring of softened, or diffused, light to the areas closer to the streetlight. A combination of reflected and softened light is cast directly below the streetlight.

Conclusion, Ramifications, and Scope

Accordingly, the reader will see that the combination diffusion/reflection lighting shield of the invention provides a more efficient method of outdoor lighting by diffusing light at small linear distances and reflecting light to large linear distances. The shield decreases the amount of light needed to illuminate an area and decreases light pollution, thereby reducing energy costs. As compared with conventional streetlight shield designs, the combination diffusion/reflection shield improves the visibility of an area, providing a safer environment for drivers and pedestrians.

While the above description contains many specificities, these should not be construed as limitations on the scope of the invention, but rather as an exemplification of one preferred embodiment thereof. Many other variations are possible. For example, the reflective truncated cone could be made shorter or taller to accordingly decrease or increase the amount of light reflected to areas farther from the streetlight. Likewise, the dimensions of the inverted cone could be altered to change the amount of light absorbed. The height of the diffusing cylinder could be changed to affect the amount of light diffused. Another variation could involve changing the angle between the horizontal and the truncated cone, or the angle between the truncated cone and the inverted cone. Additionally, different materials may be used to change the amount of light diffused or reflected by an individual component. The combination of all of these variable parameters causes the invention to be highly customizable for a variety of lighting requirements.

Accordingly, the scope of the invention should be determined not by the embodiments illustrated, but by the appended claims and their legal equivalents.

I claim:

1. An outdoor lighting shield of substantial size for illuminating outdoor areas from a substantial height, comprising:

a a translucent diffusing cylinder b a reflective truncated cone positioned partly inside said cylinder, with the narrower end at a lower height than the wider end, and c a light absorbing inverted cone, with means for mounting said inverted cone on top of said truncated cone, whereby said lighting shield illuminates said outdoor area with decreased glare.

2. The lighting shield of claim 1 wherein said diffusing cylinder is mounted around a commercial lighting base and bulb.

3. The lighting shield of claim 1 wherein the angle between said truncated cone and the horizontal axis is increased or decreased, thereby altering the distance said truncated cone reflects light from a commercial roadway lighting bulb.

4. The lighting shield of claim 1 wherein the angle between said truncated cone end said inverted cone is increased or decreased, thereby increasing or decreasing the amount of light from said bulb that is absorbed by said inverted cone.

5. The lighting shield of claim 1 wherein said truncated cone is positioned partly inside said cylinder using a plurality of crossbars mounted at one end inside said cylinder.

6. The lighting shield of claim 1 wherein said truncated cone is extended to a vertex, with the vertex, pointing downward.

7. The lighting shield of claim 5 wherein said truncated cone has a plurality of holes through which said cross are mounted to the opposite sides of said cylinder, thereby mounting said truncated cone partly inside said cylinder.

8. The lighting shield of claim 1 further including a reflective strip mounted around the top of said cylinder.

9. The lighting shield of claim 8 wherein the angle between said strip and the horizontal axis is increased decreased, thereby altering the direction of the light from said bulb that is reflected onto said truncated cone.

10. The lighting shield of claim 8 wherein the dimensional height of said strip is shortened or lengthened, thereby decreasing or increasing the amount of light from said bulb that is reflected onto said truncated cone.

11. The lighting shield of claim 5 wherein said crossbars are screwed, glued, or otherwise bonded at the other end to said truncated cone.

* * * * *